United States Patent [19]

Hess

[11] Patent Number: 4,524,852

[45] Date of Patent: Jun. 25, 1985

[54] PLASTIC SIDING SAMPLE CASE

[75] Inventor: Grant F. Hess, Charlotte, N.C.

[73] Assignee: National Gypsum Company, Dallas, Tex.

[21] Appl. No.: 500,096

[22] Filed: Jun. 1, 1983

[51] Int. Cl.[3] ..... A45C 11/00

[52] U.S. Cl. ..... 190/16; 150/52 B

[58] Field of Search ..... 190/16; 150/52 R, 52 C, 150/52 B

[56] References Cited

U.S. PATENT DOCUMENTS 1,128,542 2/1915 Steinthal ..... 190/16
1,290,486 1/1919 Baldwin ..... 190/16
1,563,902 12/1925 Grodnick ..... 150/52 B X
2,646,143 7/1953 Daleo et al. ..... 190/16

*Primary Examiner*—Steven M. Pollard
*Attorney, Agent, or Firm*—Robert F. Hause

[57] ABSTRACT

An economical, versatile, easily changeable sample case for building materials such as plastic siding having three main panels and two narrow intermediate panels foldable into an open-ended case, with sample insert retainers on two adjacent main panels, color sample pockets on the third main panel, hook and loop fabric fasteners to hold the case closed and a handle on the exterior of one intermediate panel.

10 Claims, 6 Drawing Figures

PLASTIC SIDING SAMPLE CASE

This invention relates to a sample case having many advantageous features with a very simplified folder type form.

Generally, sample cases for vinyl siding salesmen have been in the form of a relatively expensive suitcase, with a bottom, four sidewalls and a top or lid, and in some cases, to provide more display area, both the top and the bottom are hinged to a third display section formed of the four sidewalls and a two-sided panel affixed within the four sidewalls. The wall sections of vinyl siding were stapled or glued into respective sections of the suitcase, and could not be readily interchanged with wall sections of different color and siding width.

The present invention is directed to a very attractive and rich looking case which is formed essentially of a large folder made of a plurality of rigid panels, having a unitary molded plastic skin which holds the panels together along flexible hinge lines. The outer two main panels overlap like a three-section folder, forming an open-ended container. Sample insert retainers on two main sections function as end walls of the case, finishing off the completed appearance of an attache case.

It is an object of the present invention to provide an improved but very economical sample case for displaying building material samples.

It is a further object to provide an economical display case with means for easy substitution of sample panels.

It is a still further object to provide a lightweight, compact case with all elements coacting in a most efficient manner.

These and other objects and advantages of the invention will be more readily apparent when considered in relation to the preferred embodiments of the invention as set forth in the specification and shown in the drawings in which.

Figure 1:
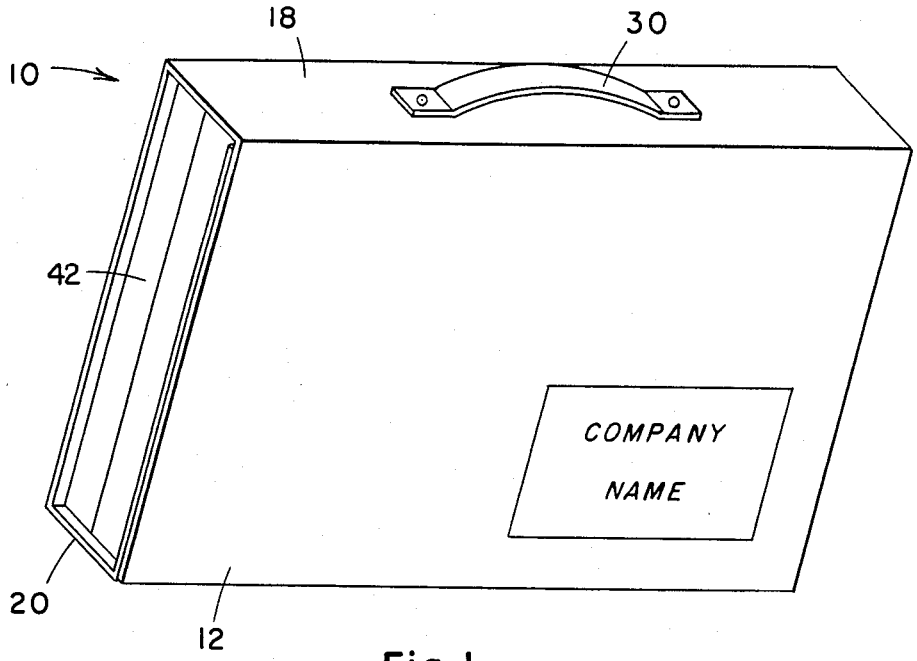
FIG. 1 is an isometric view of the sample display case of the invention, closed and in condition to be carried.

Referring to the drawings, there is shown a sample display case 10 which consists essentially of three equal size, rigid, flat main panels, left outer panel 12, middle panel 14, and right outer panel 16, which are separated by two intermediate narrow rigid, flat panels 18, 20, which five panels, when folded together form an open-ended folder.

The two narrow panels 18, 20 have a width such that, when the panels are all folded together, the case 10 is of the size of an attache case.

In the preferred form, the five panels are formed from two flexible polyvinyl chloride sheets 22, 22 with a leather grain design impressed thereon, which two sheets have rigid boards 24, of about $\frac{1}{8}$ inch thickness, disposed therebetween defining the sizes of the five panels 12, 14, 16, 18, 20. The two sheets 22, 22 are heat sealed together around their entire outer periphery 26 and also along flexible hinge lines 28, whereat the laminated vinyl sheets function to join main panels 12, 14, 16 to narrow panels 18, 20, and further function as hinges between the panels.

Narrow panel 18 forms the top of case 10 and has a strap handle 30 on the outside thereof, riveted to panel 18, which is convenient for carrying case 10. Narrow panel 20 forms the bottom of case 10.

Main panel 12 has a narrow vinyl strip 32 affixed along each side by a plurality of laterally extending heat seal lines 34 spaced apart there along. Pockets 36 are formed between each heat seal line 34 adapted for receiving a plurality of relatively small color samples 38 of the building material being displayed by case 10. Eight color samples 38 are shown, each extending from within a pocket 36 outward to the middle of panel 12 whereat the color samples of the two opposite sides meet. Color samples 38 are also preferably held in place by a spot of adhesive under the center of the sample.

To protect the cleanliness of the color samples 38, a protective flexible vinyl sheet cover 40 is disposed to cover the color samples 38 and is heat sealed to the top edge of main panel 12, whereby it can be folded up over the top edge to expose color samples 38 when desired. Small Velcro hook and loop fastener buttons 41 are adhered to the underside of cover 40 and the bottom edge of panel 12 to hold cover 40 in the closed position.

Main panels 14 and 16 each have a pair of sample assembly insert semi-rigid plastic retainers 42, one at each panel top and one at each panel bottom. Each retainer 42 includes a base 44 adhered to one of the panels 14 or 16, an outer wall 46, a top wall 48 and two small end walls 50, 50. Each retainer 42 forms an inwardly opening semi-rigid channel for receiving and holding one end of a sample assembly insert 52.

Figure 4:
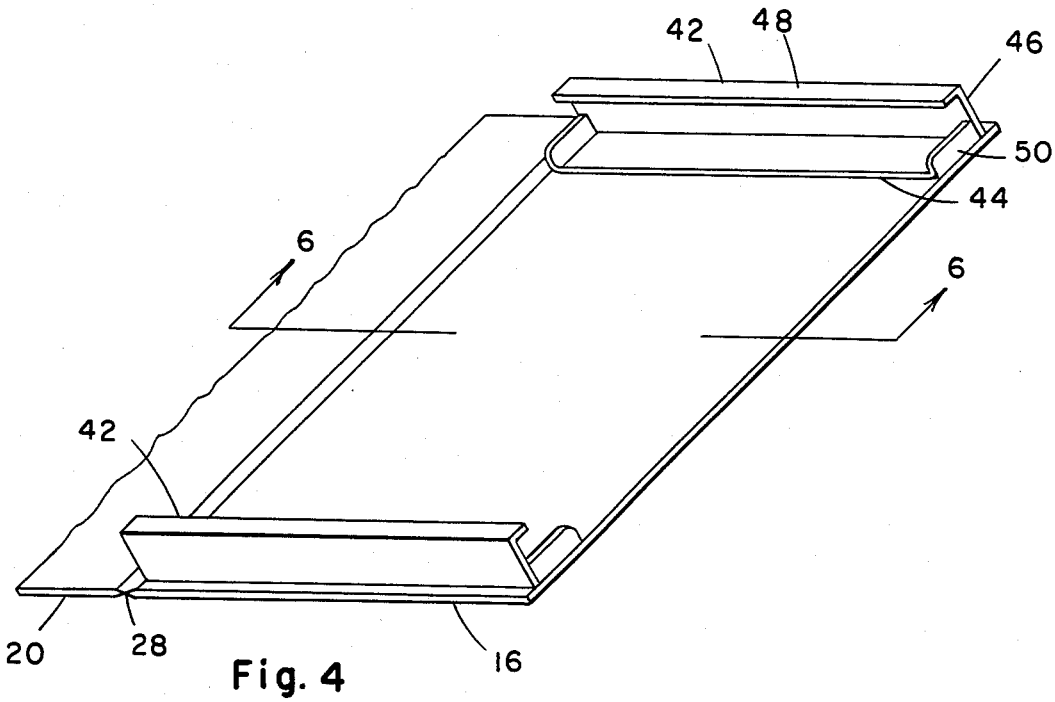
FIG. 4 is an isometric view of the right main panel showing the sample insert retainers with the sample insert removed.
Figure 6:
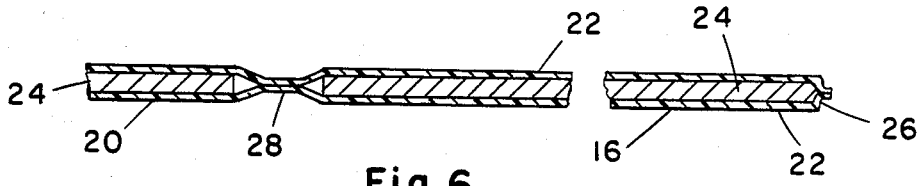
FIG. 6 is a cross-sectional end view of the right main panel, taken on line 6—6 of FIG. 4.
Figure 5:
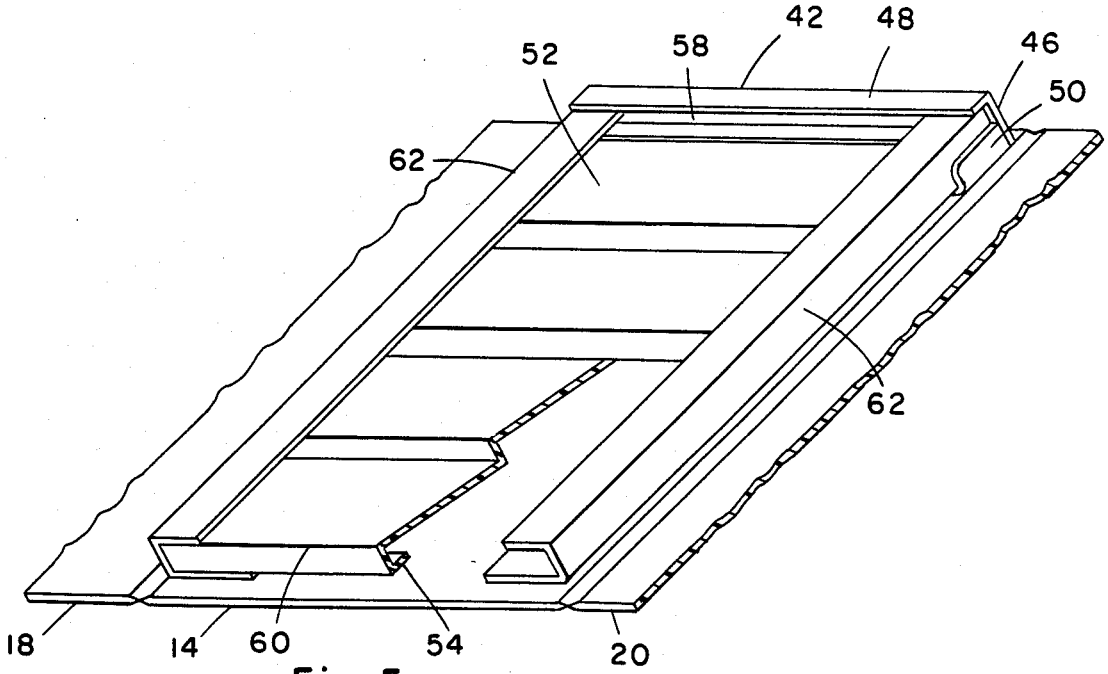
FIG. 5 is an isometric view of the center main panel with the lower sample insert retainer removed and a portion of the vinyl siding sample broken away.

Two sample assembly inserts 52, 52' are in each case 10, preferably with different building material samples in each. In the embodiment shown in FIG. 3 an assembly of horizontal vinyl siding 54 is seen in the insert 52 on panel 14 and an assembly of vertical vinyl siding 56 is seen in insert 52' on panel 16. Insert 52, shown in FIG. 5, is inserted into a pair of retainers 42 on panel 14, similar to the pair of opposed retainers 42, shown in FIG. 4, by inserting the top end 58 of insert 52 under the top wall 48 of the remote retainer 42 and rotate the insert 52 down against panel 14 with the bottom end 60 being placed under the nearer retainer 42 by bending the nearer retainer back away from the insert 52 with one's fingers until the insert 52 is in place, at which time the nearer retainer 42 is released and allowed to snap back into place, holding insert 52 in place.

Each sample assembly insert 52, 52' consists of a pair of rigid vinyl side runners 62 with a plurality of siding sections 54 or 56 stapled to runners 62, forming a rigid rectangular assembly of sections of siding samples and runners. The runners 62 have a height of about one inch. The retainers 42 have a channel opening of about one inch in height, and a width equal to the width of the sample assembly insert 52, preferably about one foot.

Figure 2:
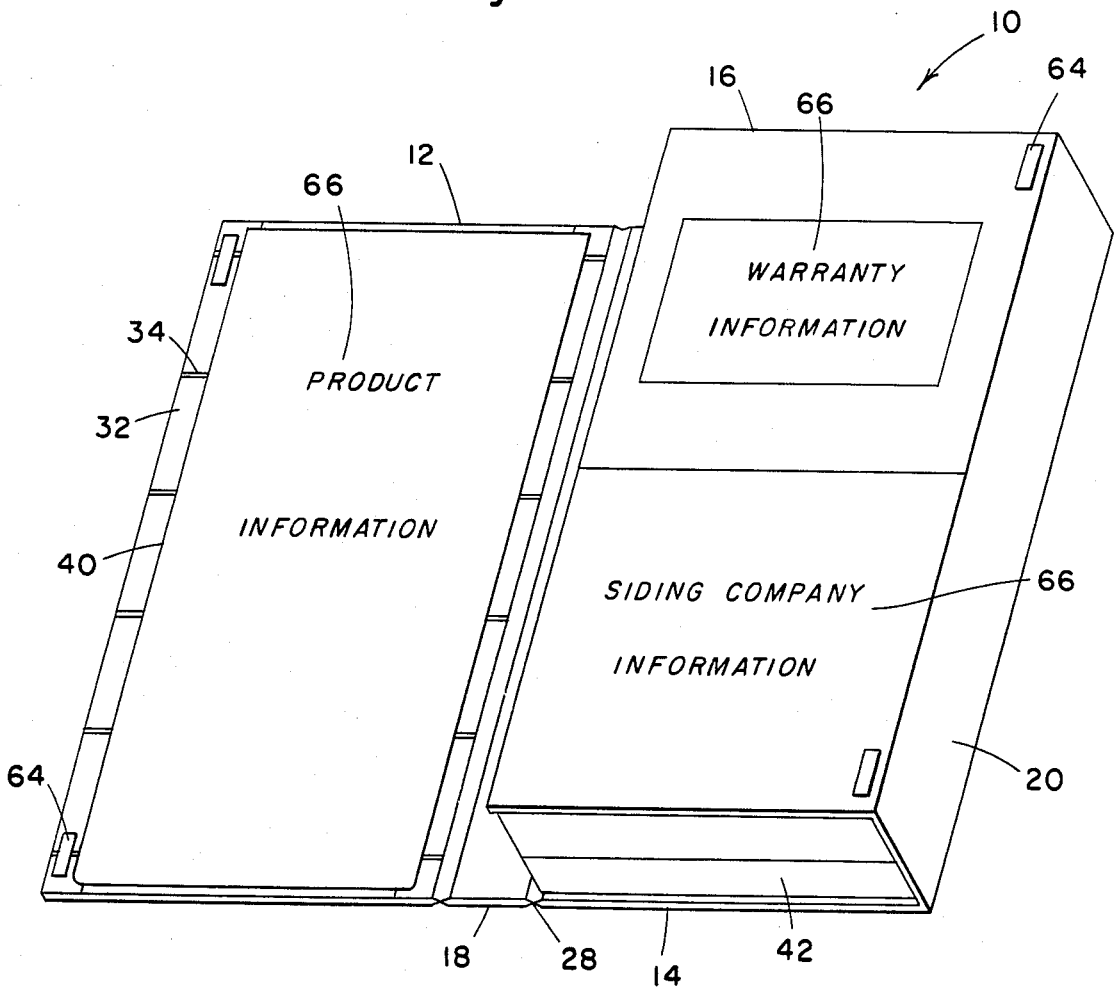
FIG. 2 is an isometric view of the sample case of FIG. 1, with a left main panel fully opened and a right main panel folded inward over the center main panel.

With the inserts 52, 52' in place, the right main panel 16 can be folded up and over onto the center main panel 14, to the partly folded condition shown in FIG. 2.

Narrow panels 18, 20 are of about two and a half inch width, whereby the retainers 42 on panel 16 rest firmly on the retainers of panel 14, forming the end walls of case 10. As seen in FIG. 2, short strips of Velcro hook and loop fastener material 64 are adhered to the left inner face outer edge of panel 12 and the right outer-face outer edge of panel 16. To finish closing case 10, panel 12 is folded up and over onto the top of the outer face of panel 16, with the Velcro fasteners 64 engaging and locking the case closed.

Figure 3:
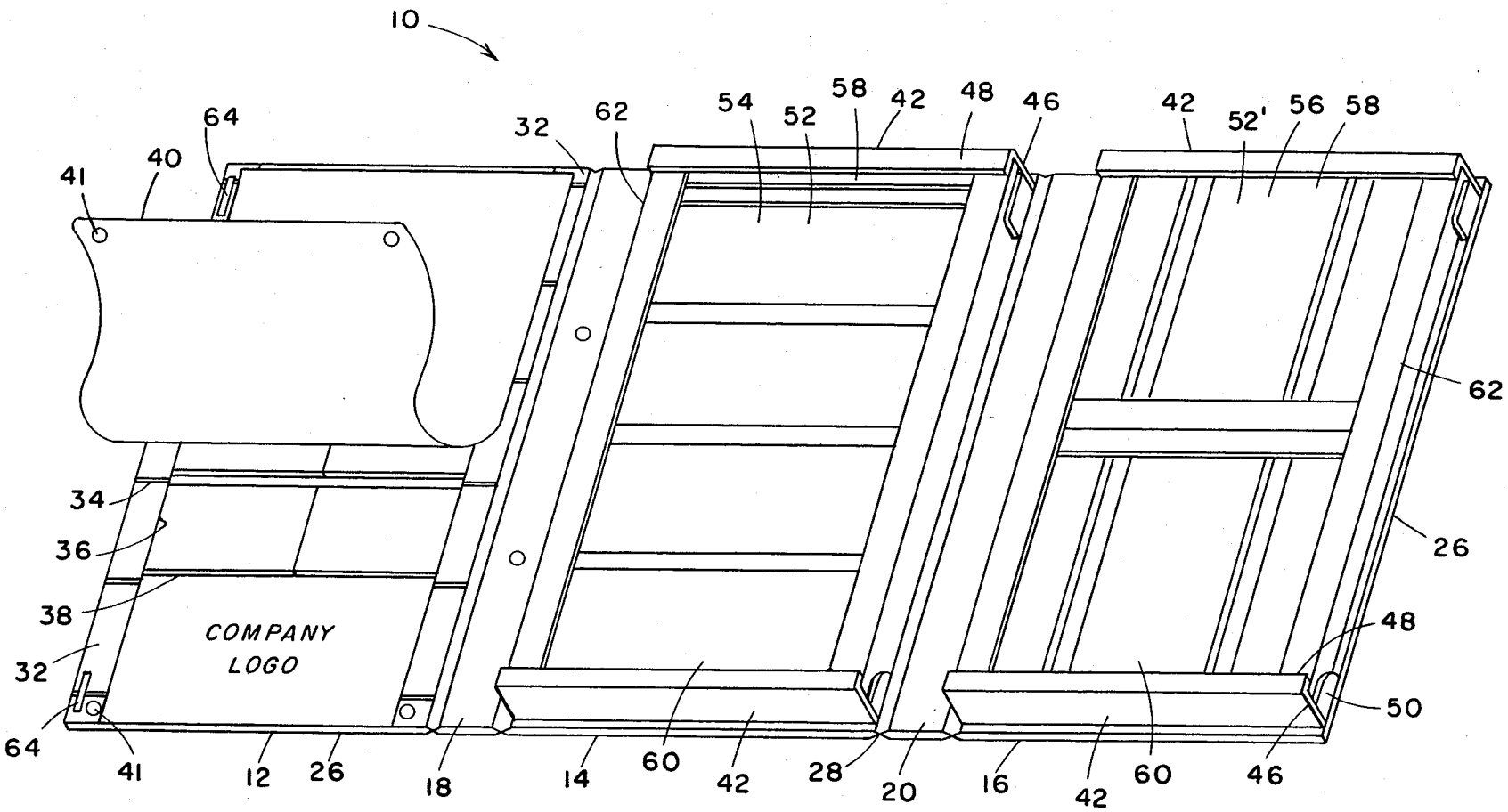
FIG. 3 is an isometric view of the sample case of FIG. 1, in fully opened condition for displaying sections of vinyl siding.

As shown in FIGS. 1, 2 and 3 various printed areas 66 provide information to assist a salesman when using the case 10.

As can be seen from the description, a very economical display case is provided, having a rich leather attache case appearance, with the ability to replace samples readily, when calling on customers of different known color preference, or when changes are made in the structure of the product being sold.

The terms rigid and semi-rigid in this specification are not intended to be construed narrowly, but are intended to be loosely interpreted, possibly overlapping in scope.

Having completed a detailed disclosure of the preferred embodiment of my invention, so that others may practice the same, I contemplate that variations may be made without departing from the essence of the invention.

I claim:

1. A sample case comprising three wide rigid flat main panels hingedly connected to two narrow rigid flat panels along the side edge of said narrow panels, said narrow panels each being between a pair of main panels, a sample building siding assembly insert on each of a middle and a first outer retainer means on, respectively, said middle and first outer main panels, said retainer means being adapted to removably retain said sample building siding assembly inserts on each respective middle and first outer panel, said retainer means each including elements disposed near the bottom and near the top of said middle and first outer panels which have a total width substantially equal to the width of said narrow panels, and which in a folded together condition, abut one another at the bottom and at the top and together form two end walls of said case, said two retainer means having a total thickness substantially equal to the width of said narrow panels, whereby said first outer panel can be folded over onto said middle panel and said two retainer means will abut and hold said middle and said first outer panels in spaced parallel relation, spaced apart a distance equal to the total thickness of said two retainer means, and a second outer panel can be folded onto the outer face of said first outer panel.

2. A sample case as defined in claim 1 wherein said retainer means on each of said middle and first outer panels consist essentially of a semi-rigid inwardly opening channel at the bottom edge of each said middle and first outer panel and a second semi-rigid inwardly opening channel at the top edge of each said middle and first outer panel.

3. A sample case as defined in claim 2 wherein said retainer means are formed semi-rigid polyvinyl chloride channel members.

4. A sample case as defined in claim 1 wherein said sample building siding assembly insert consists essentially of a pair of elongate rigid side runners with an assembly of sample building siding material affixed therebetween.

5. A sample case as defined in claim 4 wherein said second outer panel has a plurality of relatively small color samples affixed to the inner face thereof, said color samples being of a plurality of colors and being small sections of the sample building siding material in said sample building siding assembly insert.

6. A sample case as defined in claim 5 further comprising a flexible cover affixed to the inner face of said second outer panel, adapted to cover and maintain cleanliness of said color samples.

7. A sample case as defined in claim 1 wherein said main panels and said narrow panels are a unitary element formed by heat sealing together two predecorated vinyl sheets with rigid boards disposed between said sheets defining the size and shape of said panels.

8. A sample case as defined in claim 1 having a handle rigidly affixed to the outside of one of said narrow panels.

9. A sample case as defined in claim 1 further comprising hook and loop fabric fasteners affixed to said case, disposed to hold said second outer panel in folded position on the outer face of said first outer panel.

10. A sample case as defined in claim 1 wherein said sample building siding assembly inserts contain a plurality of sections of vinyl siding assembled to represent a small section of a vinyl siding exterior wall.

* * * * *

UNITED STATES PATENT AND TRADEMARK OFFICE

CERTIFICATE OF CORRECTION

PATENT NO. : 4,524,852

DATED : June 25, 1985

INVENTOR(S) : GRANT F. HESS

It is certified that error appears in the above-identified patent and that said Letters Patent are hereby corrected as shown below:

Column 3, line 40, the comma ---,--- after "which" is missing.

Signed and Sealed this

*Eighth* Day of *October 1985*

[SEAL]

*Attest:*

DONALD J. QUIGG

*Attesting Officer*

*Commissioner of Patents and Trademarks—Designate*

UNITED STATES PATENT AND TRADEMARK OFFICE

CERTIFICATE OF CORRECTION

PATENT NO. : 4,524,852

DATED : June 25, 1985

INVENTOR(S) : GRANT F. HESS

It is certified that error appears in the above-identified patent and that said Letters Patent are hereby corrected as shown below:

Column 3, line 40, the comma ---,--- after "which" is missing.

Column 4, line 24, after "small", ---thin--- is omitted.

This certificate supersedes certificate of correction issued October 8, 1985.

Signed and Sealed this

*Fifth* Day of *November 1985*

[SEAL]

*Attest:*

*Attesting Officer*

DONALD J. QUIGG

*Commissioner of Patents and Trademarks*